US008522767B1

(12) United States Patent
Kuhn

(10) Patent No.: US 8,522,767 B1
(45) Date of Patent: Sep. 3, 2013

(54) BOWSTRING VIBRATION AND NOISE ELIMINATOR

(76) Inventor: Todd Kuhn, North East, MD (US)

( * ) Notice: Subject to any disclaimer, the term of this patent is extended or adjusted under 35 U.S.C. 154(b) by 15 days.

(21) Appl. No.: 13/443,333

(22) Filed: Apr. 10, 2012

Related U.S. Application Data

(63) Continuation-in-part of application No. 12/800,874, filed on May 25, 2010, now Pat. No. 8,276,576.

(51) Int. Cl.
*F41B 5/20* (2006.01)

(52) U.S. Cl.
USPC ..... 124/89; 124/25; 124/25.6

(58) Field of Classification Search
USPC ..... 124/23.1, 25, 25.6, 86, 88, 89, 92
See application file for complete search history.

(56) References Cited

U.S. PATENT DOCUMENTS 5,452,704 A * 9/1995 Winebarger ..... 124/92
5,720,269 A * 2/1998 Saunders ..... 124/86
6,237,584 B1 5/2001 Sims
6,761,158 B2 7/2004 Wright
7,753,044 B2 * 7/2010 Goade ..... 124/89
7,793,646 B2 * 9/2010 Cooper et al. ..... 124/89
8,011,356 B2 * 9/2011 Gordon et al. ..... 124/88

* cited by examiner

*Primary Examiner* — John Ricci
(74) *Attorney, Agent, or Firm* — Brian S. Steinberger; Law Offices of Brian S. Steinberger, P.A.

(57) ABSTRACT

Devices, systems and methods preventing transfer of vibration from a bowstring, crossbow string or buss cable(s) and simultaneously silences the components from making audible noise. At least one finger with a longitudinal friction contact surface and/or integral brush combination can be mounted adjacent to the strings/cable(s) when in neutral at-rest positions. Upon release, the bowstring, crossbow string or buss cable(s) can travel along a path parallel to the rigid finger to rub against a longitudinal friction contact surface and/or through brush bristles. Kinetic energy of the strings/cables are transferred to the bristles or contact surface without inducing any vibration in the bow or crossbow, and the strings/cable(s) quickly returns to at-rest positions without audible vibration.

15 Claims, 10 Drawing Sheets

BOWSTRING VIBRATION AND NOISE ELIMINATOR

CROSS REFERENCE TO RELATED APPLICATIONS

This invention is a Continuation-In-Part of U.S. application Ser. No. 12/800,874 filed May 25, 2010.

FIELD OF THE INVENTION

The present invention relates to the field of archery. Specifically, the invention relates to devices, systems and methods used to diminish undesirable bowstring or crossbow or buss cable(s) vibration and noise following arrow projectile release.

DESCRIPTION OF THE PRIOR ART

It is well established in the field of archery that the act of drawing and releasing a bowstring causes the bowstring to oscillate before finally coming to rest at a neutral position. This high frequency oscillation results in an audible "twang" and translates much of the vibrational energy to the bow.

Often such an audible twang may be loud enough to spook a target animal. The spooked animal may move suddenly, thereby causing the already released arrow to strike a less desirable portion of the target or not at all. Vibrational energy translated to the bow is ultimately translated to the hand holding the bow, leading to hand fatigue that can decrease the archer's performance upon the next draw.

Prior art addresses this problem in a variety of ways. One mature concept employs hard stops, typically of varying rubber-like elastomeric material. The prior art devices are positioned on the bow at approximately the neutral bowstring position. Once released, the bowstring travels in the forward direction only so far as the neutral position before striking the hard stop. Such a device truncates the power stroke of the bowstring, translates a large spike of kinetic energy into the bow riser, and merely replaces the audible 'twang' with a muted, but also audible, 'thud'.

Other prior art includes small devices called string silencers of varying geometries that are attached directly to the bowstring. These silencers attempt to dissipate a vibrating bowstring's energy by moving flexible appendages or viscoelastic material. However, they are always attached to the bowstring, and they affect the bowstring performance even during the draw and power stroke.

What is needed is a device that does not affect a bowstring performance from draw through power stroke yet quickly and silently decelerates the bowstring following the power stroke without translating any vibrational energy to the bow or user's bow hand.

SUMMARY OF THE INVENTION

A primary objective of the present invention is to provide devices, systems and methods for bows and crossbows that diminish undesirable bowstring or crossbow or buss cable vibration and noise following arrow projectile release.

A secondary objective of the present invention is to provide devices, systems and methods for bows and crossbows that do not affect a bowstring performance from draw through power stroke, yet quickly and silently decelerates the bowstring and/or buss cable following the power stroke without translating any vibrational energy to the bow or user's bow hand.

The present invention can include devices, systems and methods that prevents the transfer of vibration from a bowstring or crossbow string or buss cable(s) to a bow riser and simultaneously silences the strings and/or cable(s) from making audible noise.

The invention can mount to the stock or riser of a bow or crossbow, and can mount to another surface, and disposes at least one rigid finger with an integral string facing surface or integral brush combination adjacent to the bowstring or crossbow string and/or buss cable(s) when the bowstring or crossbow string and/or buss cable(s) is in the neutral at-rest position.

Upon release, the bowstring or crossbow string travels along a path parallel to the rigid finger to frictionally rub against a longitudinal surface on one side of the finger or through brush bristles attached to one side of the finger. Kinetic energy of the bowstring and/or buss cable(s) is transferred to the friction surface or to the brush bristles without inducing any vibration in the bow riser. And the bowstring or crossbow string and/or buss cable(s) quickly returns to the at-rest position without audible vibration.

Further objects and advantages of this invention will be apparent from the following detailed description of the presently preferred embodiments which are illustrated schematically in the accompanying drawings.

DETAILED DESCRIPTION OF THE INVENTION

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

The present invention is a device, system and method that prevents the transfer of vibration from a bowstring to a bow riser or crossbow stock and, by eliminating bowstring vibration, also silences the bowstring from making audible noise upon release.

Figure 1:
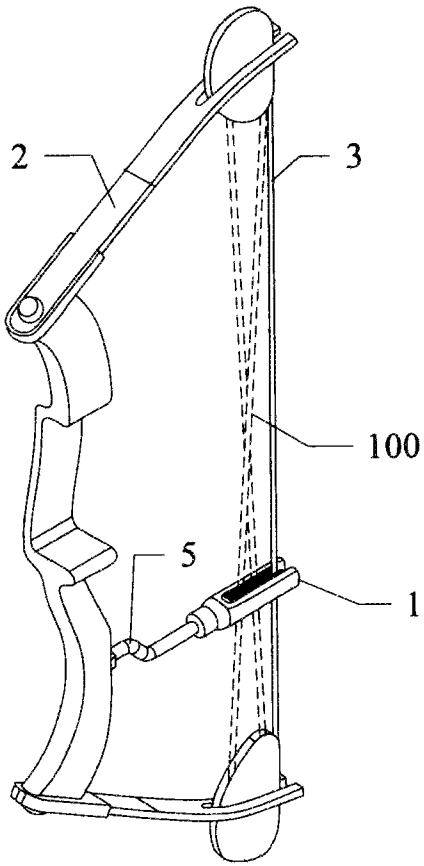
FIG. 1 is an oblique view of a compound bow outfitted with a first embodiment of the present invention.
Figure 2:
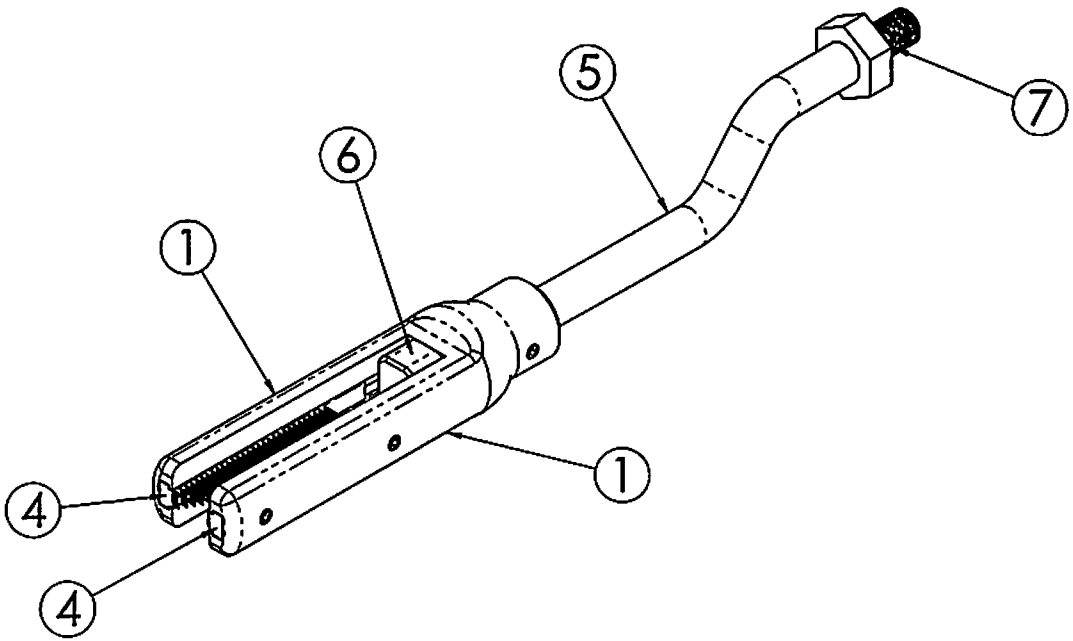
FIG. 2 is a detailed view of a first embodiment of the present invention.

With reference to FIGS. 1, 2, 2A, 2B, and 2C, a first embodiment of the invention includes a support arm 5. At a first end, support arm 5 terminates at a mounting end 7 that can attach the invention to the riser of compound bow 2. In the preferred embodiment, mounting end 7 is a threaded post typical in the art for attaching accessories to a bow. Support arm 5 may or may not include a threaded locking nut. Support arm 5 may be straight or include a gentle s-shaped curve as shown in FIG. 2. Mounting end 7 is not limited to a threaded post. One of ordinary skill in the art would understand that other equivalent means can be used to mount the invention to a bow riser or subsequent portion or appendage of an archery bow or crossbow.

At a second end, support arm 5 terminates in at least one rigid finger 1. Each finger 1 further comprises a brush 4 attached to finger 1. Brush 4 is oriented on the side of finger 1 that is adjacent to bowstring 3 and includes a plurality of flexible bristles. The bristles of brush 4 must be at least long enough to make contact with bowstring 3 as it moves in a line parallel to finger 1.

Figure 2C:
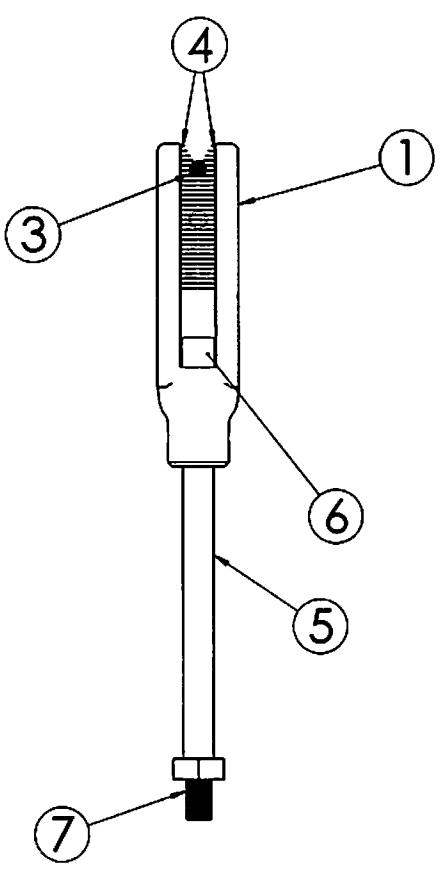
FIG. 2C is an overhead view of the present invention wherein the bowstring is in the maximum rearward position as it vibrates to rest following release.
Figure 2B:
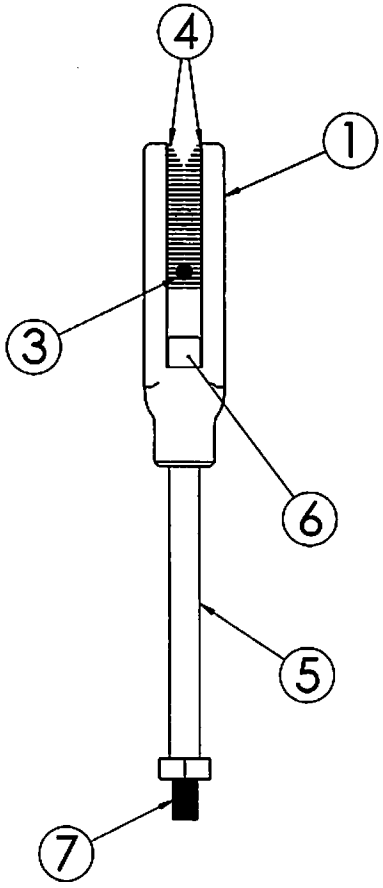
FIG. 2B is an overhead view of the present invention wherein the bowstring is in the maximum forward position at the end of the power stroke following release.
Figure 2A:
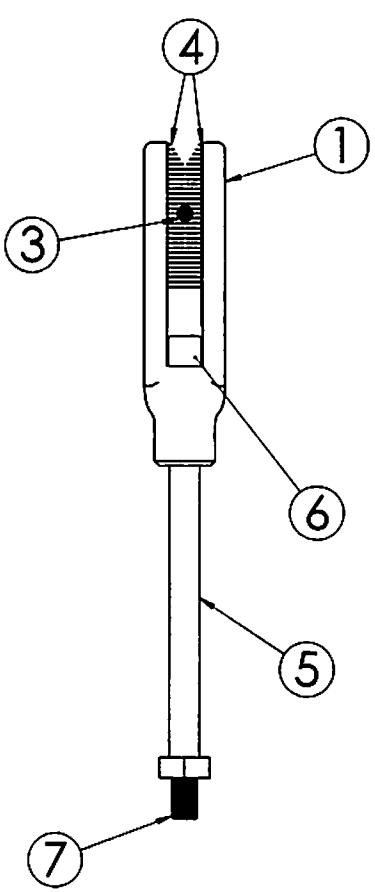
FIG. 2A is an overhead view of the present invention wherein the bowstring is in the neutral, at-rest position.
Figure 4:
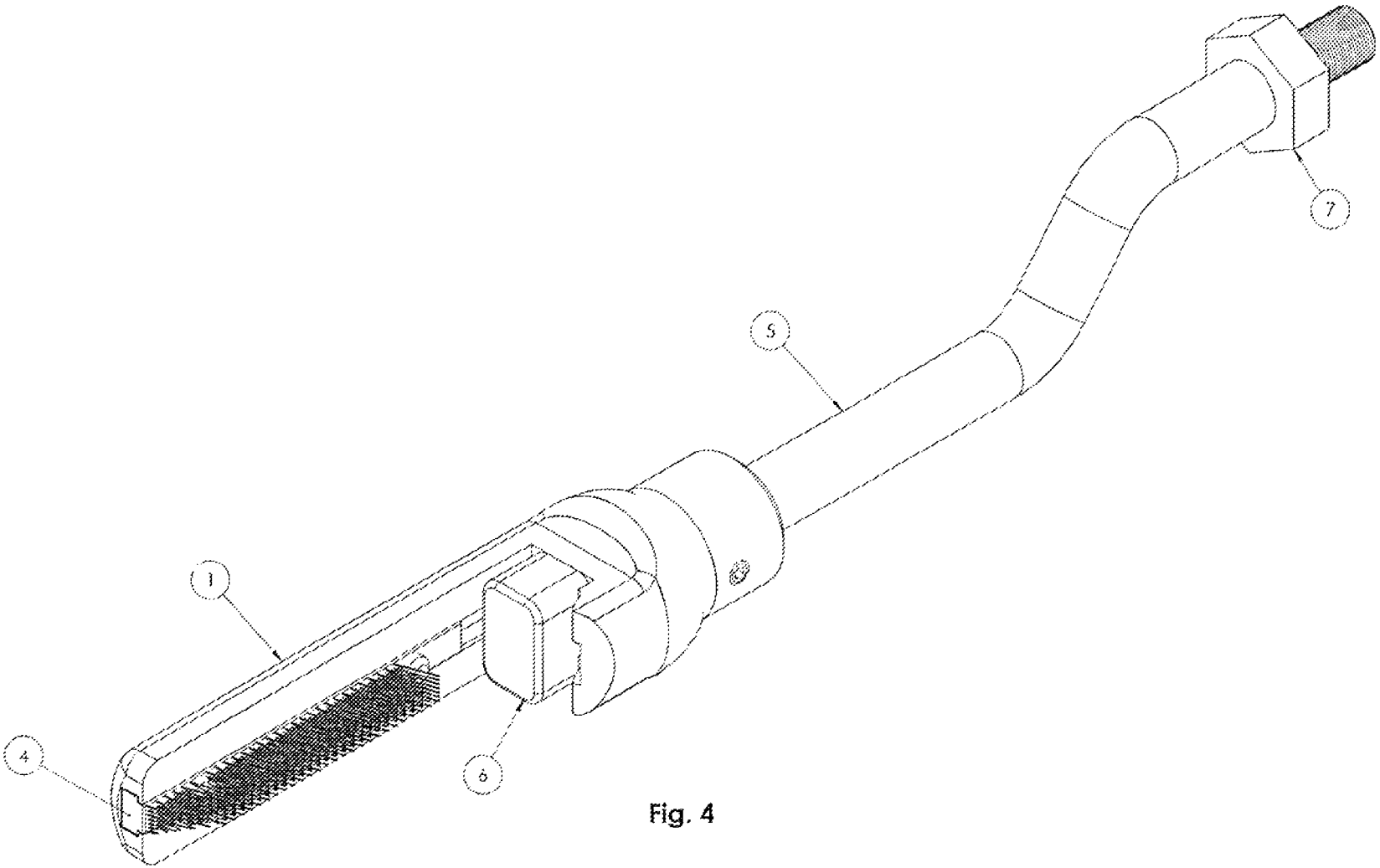
FIG. 4 is a detailed view of a third embodiment of the present invention.

In the preferred embodiment, the second end of support arm 5 includes two fingers 1 arranged in such a geometry that there is one finger 1 disposed on opposing sides of bowstring 3 when bowstring 3 is at rest. As shown in FIGS. 2A, 2B, and 2C, the flexible bristles of brushes 4 are long enough to make contact with bowstring 3 at any point along the length of brushes 4. The bristles of a first brush 4 may be just long enough to make contact with, may overlap, or may make no contact with the bristles of a second, opposing brush 4 so long as contact with bowstring 3 is maintained by all brushes 4. In a second embodiment of the invention, only a single finger 1 is disposed on the side of bowstring 3 as shown in FIG. 4.

Figure 5A:
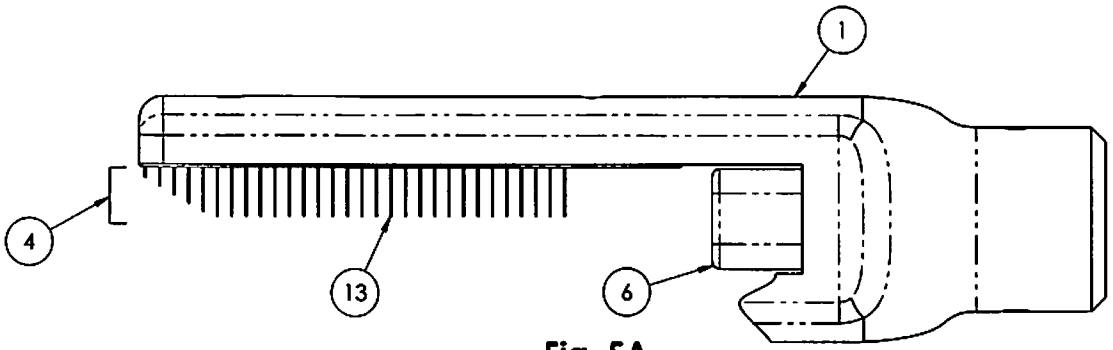
FIG. 5A is a detailed view of the present invention showing a first bristle embodiment.
Figure 5B:
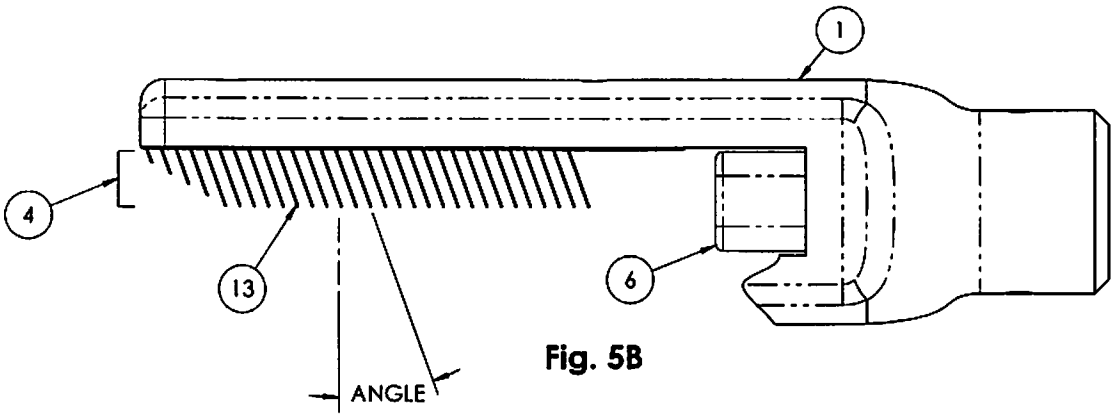
FIG. 5B is a detailed view of the present invention showing a second bristle embodiment.

The brushes 4 are a key feature of the present invention. The bristles of brush 4 are preferentially oriented either perpendicular to the surface of finger 1, as shown in FIG. 5A, or angled forwards towards mounting end 7 at an angle in the range of about five degrees and about forty-five degrees relative to the perpendicular direction, as shown in FIG. 5B. The bristles can be fabricated from stiff or flexible material such as, but not limited to, natural hair, polymers, or elastomers.

In operation, the invention quickly brings released bowstring 3 to rest at a neutral position. The invention is attached to the riser of bow 2 and adjusted forward or backward using set screws so that the neutral position of bowstring 3 is approximately half way along the length of brushes 4 as shown in FIG. 2A.

Upon draw and release, bowstring 3 travels forward along a line parallel to fingers 1. At the end of forward motion, i.e., the maximum power stroke, bowstring 3 has moved through brushes 4 to the position shown in FIG. 2B yet makes no hard contact with any portion of the invention except for the flexible brushes 4. There is no friction nor string impediment while the string is travelling forward through the power stroke.

Bowstring 3 then oscillates in the reverse direction, again moving through brushes 4, to the position shown in FIG. 2C. Bowstring 3 completes no more than a few oscillation cycles before coming to rest. During these minimal oscillations, kinetic energy of bowstring 3 is transferred to bristles 13 of brushes 4 without inducing any vibration or noise in the bow riser. In a preferred embodiment the angled bristles impede the rearwardly travelling string as the string is moving back to a neutral position, and transfers the kinetic energy of the bow to the bristles eliminating vibration and noise effects. Bowstring 3 has low mass and therefore low inertial moment.

A free bowstring may vibrate for several seconds if not damped, while a bowstring used with the present invention is brought to rest almost immediately after release.

A traditional elastomeric stop 6 is positioned ahead of brushes 4 in the event that the device has not been properly installed and the neutral position of bowstring 3 is too far forward. If the present invention is set to the appropriate position, bowstring 3 should never make contact with stop 6. Elastomeric stop 6 prevents unintentional damage to bowstring 3 due to this potential improper installation of the invention.

Figure 3:
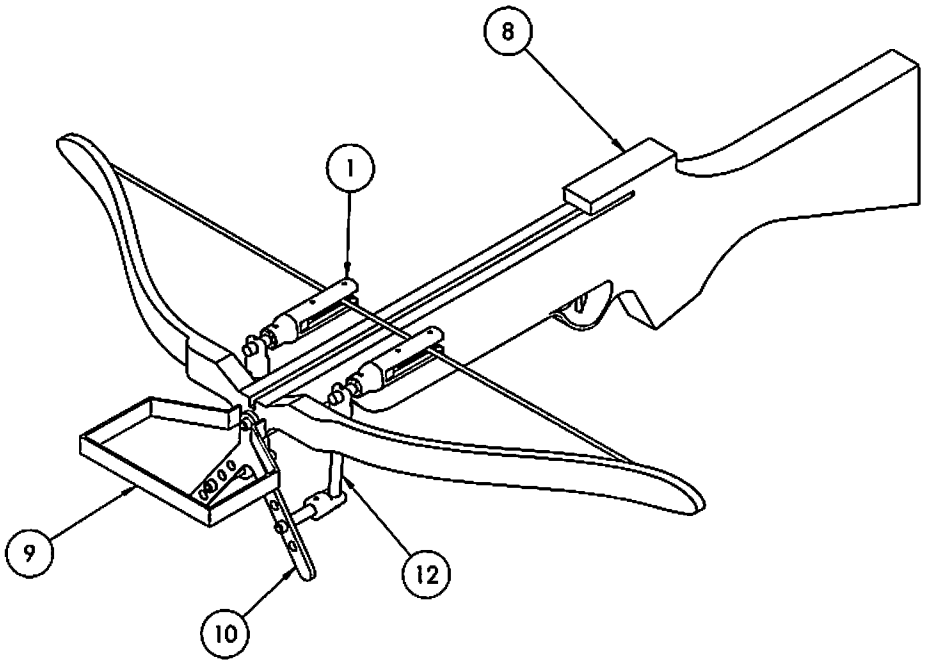
FIG. 3 is an oblique view of a crossbow outfitted with a second embodiment of the present invention.
Figure 3A:
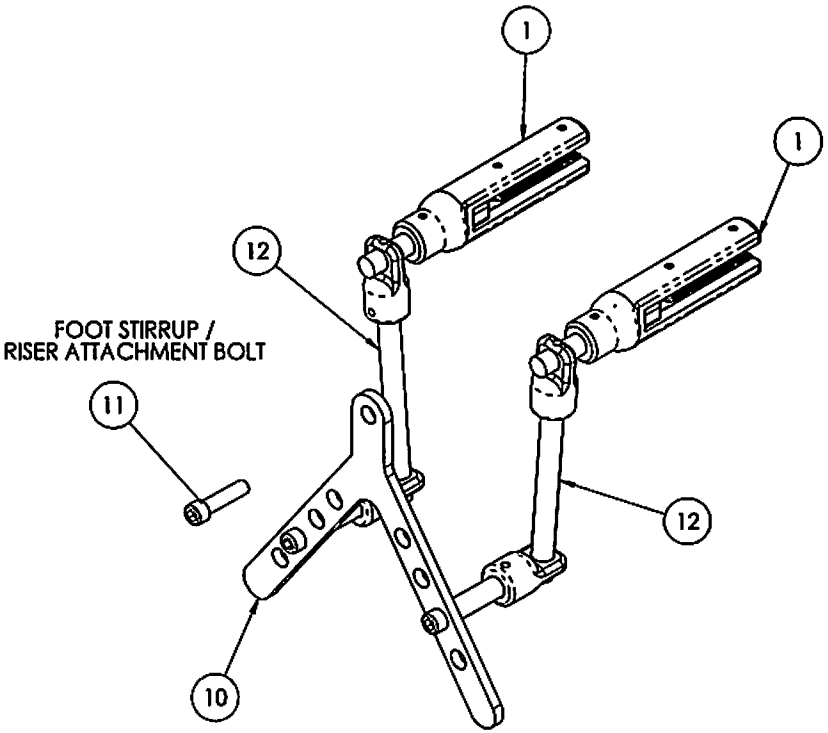
FIG. 3A is a detailed view of a second embodiment of the present invention.

In a third embodiment, the present invention can be mounted to a crossbow as shown in FIGS. 3 and 3A. At least one articulated support arm 12 terminates at a first end by bracket 10 that can, in turn, attach the invention to the foot stirrup or riser of crossbow 8. In the preferred embodiment, bracket 10 is connected to crossbow 8 using attachment bolt 11 as is typical in the art for attaching accessories to the forward end of a crossbow. Bracket 10 may include a plurality of attachment points, and one of ordinary skill in the art would understand that other equivalent means can be used to mount the invention to a crossbow riser.

As shown in FIG. 3, the third embodiment preferentially includes two articulated support arms 12 that each terminate at a second end in at least one rigid finger 1. The two support arms 12 and their associated fingers 1 are positioned symmetrically to the left and right of the crossbow projectile path on the crossbow string. The form and function of rigid fingers 1 and their associated brushes 4 is identical to the description provided for the first, preferred embodiment.

Figure 6:
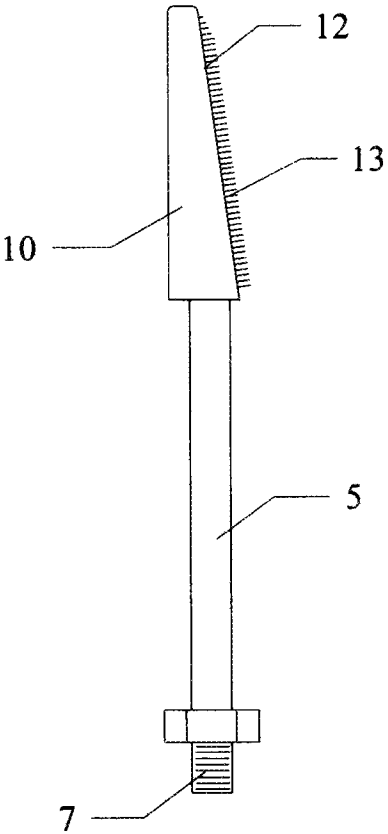
FIG. 6 is a detailed view of another embodiment of a finger with angled surface and bristles extending from the surface.

FIG. 6 is a detailed view of another embodiment of a finger 10 with angled surface 12 having an angle of about five degrees to about forty five degrees, and bristles 13 extending from the surface 12. The bristles 13 can be perpendicular to the angled surface 12 or angled forwards towards the mounting end 7 at an angle in the range of about five degrees and about forty-five degrees relative to the perpendicular direction.

Figure 7:
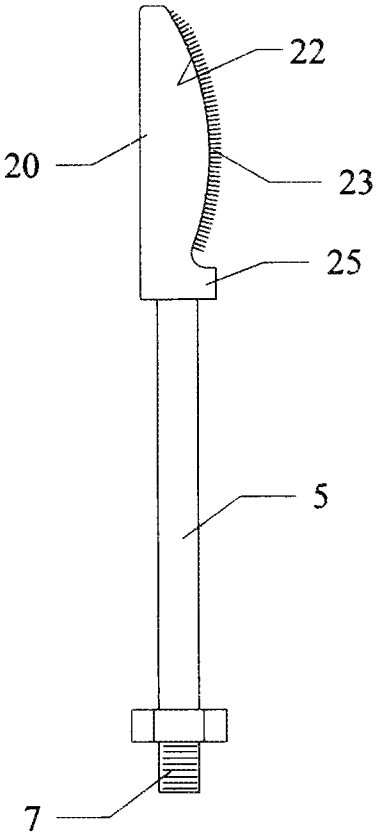
FIG. 7 is a detailed view of another embodiment of a finger with a concave rounded surface with bristles.

FIG. 7 is a detailed view of another embodiment of a finger 20 with a concave rounded surface 22 with bristles 23. The bristles 23 can be perpendicular to the angled surface 22 or angled forwards towards the mounting end 7 at an angle in the range of about five degrees and about forty-five degrees relative to the perpendicular direction.

An elastomeric stop 25 can be positioned ahead of bristles 23 in the event that the device has not been properly installed and the neutral position of bowstring 3 is too far forward.

Figure 8:
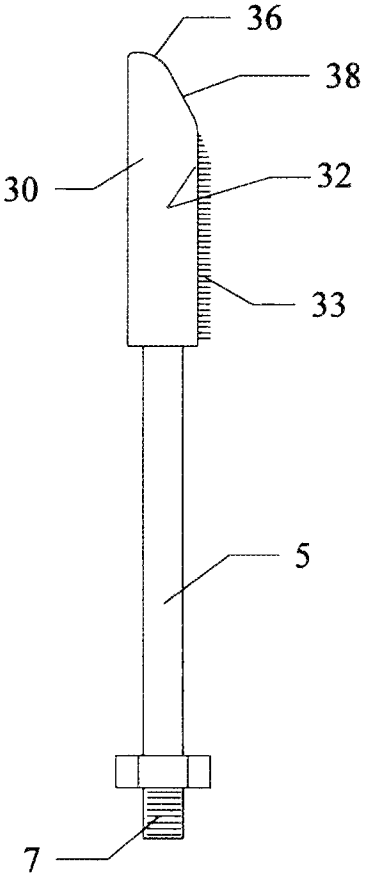
FIG. 8 is a detailed view of another embodiment of a finger with angled tip and flat sided surface with bristles.

FIG. 8 is a detailed view of another embodiment of a finger 30 with rounded end 36, angled tip 38 and flat sided surface 32 with bristles 33. The bristles 33 can be perpendicular to the generally flat surface 32 or angled forwards towards the mounting end 7 at an angle in the range of about five degrees and about forty-five degrees relative to the perpendicular direction.

Figure 9:
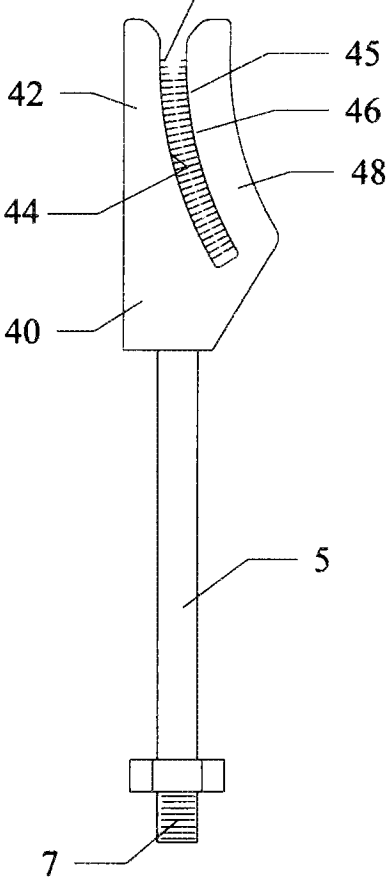
FIG. 9 is a detailed view of another embodiment of a split finger with curved slot and bristles therein.

FIG. 9 is a detailed view of another embodiment of a split finger 42, 48 with curved slot formed between interior facing surfaces 44, 46 having bristles 43, 45 on each surface facing each other therein. The bristles 43, 45 can be perpendicular to the curved interior surfaces 44, 46 or angled forwards towards the mounting end 7 at an angle in the range of about five degrees and about forty-five degrees relative to the perpendicular direction.

Figure 10:
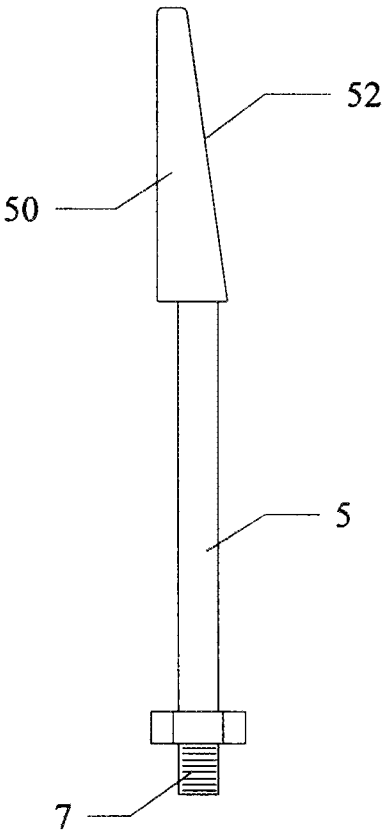
FIG. 10 is a detailed view of another embodiment of a finger with angled surface.

FIG. 10 is a detailed view of another embodiment of a finger 50 with angled surface 52 having an angle of about five degrees to about forty five degrees. The surface 52 can be smooth, bumped, ribbed. The surface can be molded from the finger 50. The entire finger 50 can be for example, formed from elastomeric materials, rubber, silicone, and the like.

Figure 11:
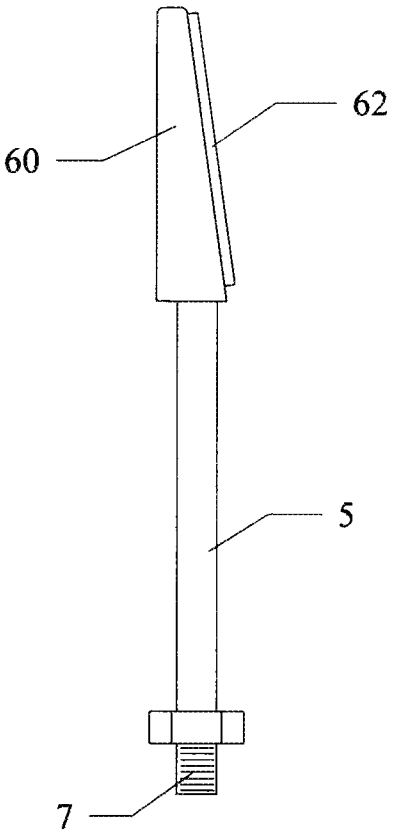
FIG. 11 is a detailed view of another embodiment of a finger with angled surface and rubbing pad thereon.

FIG. 11 is a detailed view of another embodiment of a finger 60 with angled surface 62 and rubbing pad 62 thereon. Pad 32 can be formed from a stiff or flexible material such as, but not limited to polymers, or elastomers, and the like. Surface 62 can have an angle of about five degrees to about forty five degrees.

The invention can allow for the power stroke part of the moving string which shoots the projectile to move unimpeded as it passes along the side of the finger(s), and the returning string would then rub against the longitudinal contact surface on a least one side of a finger to transfer kinetic energy to the bow or cross bow eliminating vibration and noise effects. In these versions the rubbing side of the longitudinal contact surface can be angled (such as in the angled bristles) so as to impede the travelling string.

Additionally, the invention can also work if the longitudinal contact surface along one side of the finger(s) rubs against the string in both the power stroke and returning stroke travels of the string.

Although the fingers are shown with mounting arms, the fingers can be directly mounted to the riser or stock of the bow or crossbow.

The invention can be used with buss cables 100 (as shown in FIG. 1) to eliminate the vibration and noise effects. The existing buss cable(s) on bows and crossbows also cause an undesirable noise and vibration as the bow string or the crossbow string after a projectile is launched at shot from the bow or crossbow. Bows and cross bows can each have a single buss cable or plural buss cables. The novel finger(s) can be mounted so as to prevent and eliminate the undesirable noise and vibration caused after the launching of the projectile.

The invention can be used where at least one side of a finger rubs against a bowstring and another at least one side of another finger rubs against a buss cable(s). Similarly, the invention can be used where at least one side of a finger rubs against a crossbow string and another at least one side of another finger rubs against a buss cable(s). Additionally, one finger can be used with a contact surface or contact surfaces which rubs against both a bowstring and a bus cable(s). Additionally, one finger can be used with a contact surface or contact surfaces which rubs against both a crossbow string and a bus cable(s).

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A method of eliminating bowstring or crossbow string or buss cable(s) vibration and noise, comprising the steps of:

providing a bow or crossbow having a bowstring or crossbow string or buss cables;

providing the bow or the crossbow with a stock or a riser;

providing a finger with a first end and a second end, and having at least one side with a longitudinal friction contact surface which only causes friction along one direction;

attaching the first end of the finger to the bow or the crossbow, so that the second end of the finger extends out so that the at least one side with the longitudinal friction surface is resting adjacent to the bowstring or the crossbow string;

releasing the bowstring or the crossbow string to travel forward freely without impediment in order to fire a projectile from the bow or the crossbow;

returning the bowstring or the crossbow string to a neutral position by rubbing the returning bowstring or the crossbow string or the buss cables against the longitudinal friction contact surface which only causes friction along the one direction; and transferring kinetic energy to the longitudinal friction contact surface on the at least one side of the finger.

2. The method according to claim 1, wherein the longitudinal friction contact surface is angled to the line of travel of the released bowstring or the crossbow string or the buss cables.

3. The method according to claim 1, wherein the longitudinal friction contact surface is convex curved to the line of travel of the released bowstring or the crossbow string.

4. The method according to claim 1, wherein the longitudinal friction contact surface is generally flat and parallel to the line of travel of the released bowstring or the crossbow string.

5. The method according to claim 1, wherein the longitudinal friction contact surface is formed between a curved slot where the line of travel of the released bowstring or the crossbow string passes through the curved slot.

6. The method according to claim 1, wherein the longitudinal contact surface further includes a plurality of bristles extending therefrom.

7. The method according to claim 1, wherein the longitudinal contact surface includes a pad thereon.

8. A vibration and noise eliminator for a bowstring or crossbow string of buss cables comprising:

a finger with a first end and a second end; and a longitudinal friction contact surface along at least one side of the finger between the first end and the second end of the finger, the first end of the finger adapted to attach to a bow or crossbow, the second end of the finger extending out so that the one side with the longitudinal friction surface rests adjacent to a bowstring or crossbow string of the bow or crossbow, wherein releasing the bowstring or the crossbow string travels freely without impediment in order to fire a projectile from the bow or the crossbow, and returning the bowstring or the crossbow string to a neutral position by rubbing the returning bowstring or the crossbow string or the buss cables against the longitudinal friction contact surface on the one side of the finger in order to transfer kinetic energy to the longitudinal friction contact surface on the one side of the finger to eliminate noise and vibration.

9. A vibration and noise eliminator according to claim 8, wherein the longitudinal friction contact surface is angled to the line of travel of the released bowstring or the crossbow string.

10. A vibration and noise eliminator according to claim 8, wherein the longitudinal friction contact surface is convex curved to the line of travel of the released bowstring or the crossbow string.

11. A vibration and noise eliminator according to claim 8, wherein the longitudinal friction contact surface is generally flat and parallel to the line of travel of the released bowstring or the crossbow string.

12. A vibration and noise eliminator according to claim 8, wherein the longitudinal friction contact surface is formed between a curved slot where the line of travel of the released bowstring or the crossbow string passes through the curved slot.

13. A vibration and noise eliminator according to claim 8, wherein the longitudinal contact surface further includes a plurality of bristles extending therefrom.

14. A vibration and noise eliminator according to claim 8, wherein the longitudinal contact surface includes a pad thereon.

15. A method of eliminating bowstring or crossbow string vibration and noise, comprising the steps of:

releasing the bowstring or the crossbow string in order to fire a projectile from a bow or a crossbow;

returning the bowstring or the crossbow string to a neutral position by rubbing the returning bowstring or the crossbow string or buss cables against a longitudinal friction contact surface; and transferring kinetic energy to the longitudinal friction contact surface to eliminate vibration and noise.

* * * * *